US009361798B2

(12) United States Patent
Neuman

(10) Patent No.: US 9,361,798 B2
(45) Date of Patent: Jun. 7, 2016

(54) VEHICLE CLASSIFICATION SYSTEM AND METHOD

(71) Applicant: Global Traffic Technologies, LLC, St. Paul, MN (US)

(72) Inventor: Jeremy William Neuman, Stillwater, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 17 days.

(21) Appl. No.: 14/314,637

(22) Filed: Jun. 25, 2014

(65) Prior Publication Data

US 2015/0379870 A1 Dec. 31, 2015

(51) Int. Cl.

| | |
|---|---|
| ***G08G 1/01*** | (2006.01) |
| ***G08G 1/017*** | (2006.01) |
| ***G08G 1/042*** | (2006.01) |
| ***G08G 1/015*** | (2006.01) |
| ***G08G 1/052*** | (2006.01) |
| *G08G 1/08* | (2006.01) |

(52) U.S. Cl.

CPC ..... *G08G 1/017* (2013.01); *G08G 1/015* (2013.01); *G08G 1/042* (2013.01); *G08G 1/052* (2013.01); *G08G 1/08* (2013.01)

(58) Field of Classification Search

CPC ..... H04R 5/04; G01R 31/007; G01R 31/025; G01R 13/04; G01R 13/28; G01R 13/32; G01R 13/345; A61B 5/0205; A61B 5/04; A61B 5/042; A61B 5/04525; A61B 5/053; A61B 5/0538; A61B 5/7246; A61N 1/3627

USPC ..... 340/941, 936, 943, 947, 962, 969, 972, 340/973, 978, 995.11, 995.27, 995.28, 428, 340/448, 444

See application file for complete search history.

(56) References Cited

U.S. PATENT DOCUMENTS

| | | | | |
|---|---|---|---|---|
| 3,964,024 | A * | 6/1976 | Hutton | B61L 25/043 340/10.34 |
| 7,010,401 | B1 * | 3/2006 | Richburg | G05D 1/0225 180/167 |
| 2002/0034268 | A1 * | 3/2002 | Miyanabe | G11B 7/005 375/340 |
| 2003/0011492 | A1 * | 1/2003 | Owen | G08G 1/042 340/941 |
| 2003/0163263 | A1 * | 8/2003 | Bertrand | G08G 1/042 702/65 |
| 2007/0276600 | A1 * | 11/2007 | King | G08G 1/042 701/301 |

FOREIGN PATENT DOCUMENTS

| | | | |
|---|---|---|---|
| CN | 101923781 | B | 11/2013 |
| ES | 2312245 | A1 | 2/2009 |
| JP | 4-49498 | A | 2/1992 |

* cited by examiner

*Primary Examiner* — Daniel Previl

(74) *Attorney, Agent, or Firm* — Crawford Maunu PLLC

(57) ABSTRACT

Approaches for classifying vehicles include generating a signal waveform from a signal in a single inductive loop generated by a passing vehicle. The signal waveform is compared to a first plurality of model waveforms. Each model waveform is associated with a respective class of vehicle. A first model waveform of the first plurality of model waveforms that matches the signal waveform is determined, and data indicating the respective class of vehicle associated with the first model waveform is output.

20 Claims, 5 Drawing Sheets

VEHICLE CLASSIFICATION SYSTEM AND METHOD

FIELD OF THE INVENTION

The disclosure is generally directed to classifying vehicles from signals generated as the vehicles pass an inductive loop.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

In many installations, the vehicle sensors include inductive loops embedded in the road. An intersection may have loops for each lane of traffic. The loops may also be used for data collection, such as counting the number of vehicles passing through an intersection. The gathered data may be used for improving signal timing and planning road improvements.

Two parameters that are of particular interest in traffic control and road planning are vehicle class and speed. The vehicle class typically refers to the type of vehicle, such as an automobile, pickup, van, vehicle with a trailer, box truck with 2 axles, box truck with more than 2 axles, bus, and tractor trailer. The sizes of vehicles and their speeds can significantly affect the decisions made for improving traffic flow.

Past approaches for collecting vehicle data have been limited to dual loop systems or have provided inaccurate results. One approach relies on two inductive loops embedded in a lane of a road. The space separating the loops and the times at which a vehicle is detected at each loop are used to calculate the vehicle's speed and length. The length may then be used to classify the vehicle. The dual loop approach is limited by the number of roads having embedded dual loops since there may be many road locations at which collection of traffic data is desired, but those locations have only a single loop embedded in the road.

Though some approaches use a single loop to estimate the speed of a vehicle, the results may be inaccurate. When using a single loop to collect vehicle data, it is common to assume that all vehicles have the same length. The speed may be estimated based on the assumed length and the amount of time the vehicle is over the loop. However, the speed may be inaccurate since there may be a large variance between the actual length of the vehicle and the assumed length.

SUMMARY

According to one embodiment, a method of vehicle classification includes generating a signal waveform from a signal in a single inductive loop generated by a passing vehicle. The signal waveform is compared to a first plurality of model waveforms. Each model waveform is associated with a respective class of vehicle. The method determines a first model waveform of the first plurality of model waveforms that matches the signal waveform and outputs data indicating the respective class of vehicle associated with the first model waveform.

In another embodiment, a system for classifying a vehicle passing a single inductive loop includes an oscillator coupled to the single inductive loop and a pulse comparator coupled to the oscillator. The pulse comparator is configured to generate a pulse train in response to an output signal from the oscillator. A processor is coupled to the pulse comparator, and a memory is coupled to the processor. The memory is configured with a plurality of model wave forms and with instructions that when executed by the processor cause the processor to generate a signal waveform from a signal in a single inductive loop generated by a passing vehicle. The processor compares the signal waveform to a first plurality of model waveforms. Each model waveform is associated with a respective class of vehicle. A first model waveform of the first plurality of model waveforms that matches the signal waveform is determined, and data indicating the respective class of vehicle associated with the first model waveform is output.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

The disclosed methods and systems classify vehicles passing a single inductive loop. In addition, once the class of a vehicle has been determined, the length associated with that class of vehicle and the time the vehicle was over the loop may be used to calculate the vehicle's speed.

In one implementation, the waveform of the signal generated by a single inductive loop by a passing vehicle is captured. This waveform may be referred to as the vehicle waveform or signal waveform. The signal waveform is compared to model waveforms in a set of model waveforms. The model waveforms are associated with different classes of vehicles. The model waveform that matches the signal waveform indicates the class of the vehicle. In another implementation, respective lengths are associated with the model waveforms and vehicle classes. Based on the length associated with the matching waveform and the time expended by the vehicle in passing the inductive loop, the speed of the vehicle may be calculated. Data that represent both the class of the vehicle and vehicle's speed may be output for accumulation and further processing by a data collection application.

Figure 1:
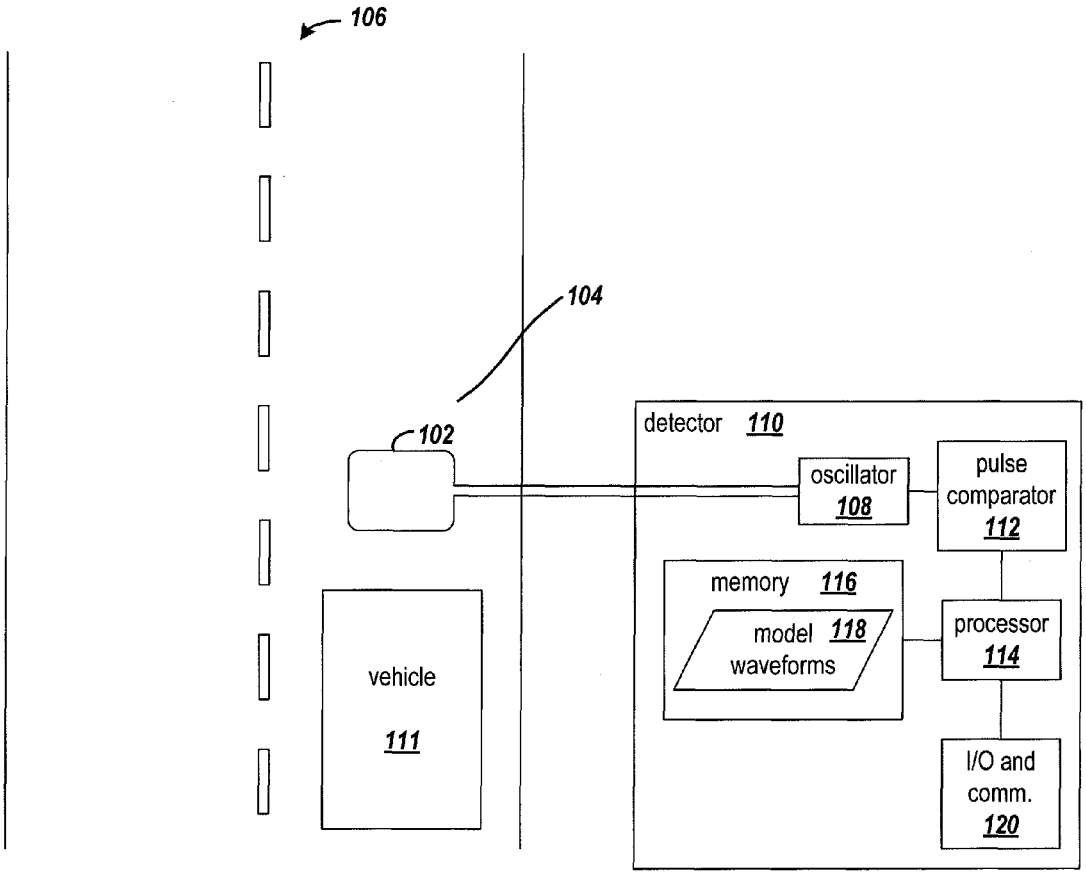
FIG. 1 illustrates a system for classifying vehicles using a single inductive loop.

FIG. 1 illustrates a system for classifying vehicles using a single inductive loop. In one implementation, the inductive loop 102 is an insulated conductive wire that is embedded in a shallow slot in the lane 104 of a road 106. The size, shape, and number of turns in the inductive loop may vary according to implementation requirements. Alternatively, the loop could be a magnetometer that is embedded in the pavement or placed in a conduit beneath the pavement.

The loop is coupled to an oscillator 108 in detector 110. The detector operates in conjunction with the loop 102 to generate discrete output signals and output data based on inductive changes to the loop. The oscillator is an LC circuit in an example implementation and generates a resonant frequency based on the inductance present at the loop. The frequency of the oscillator is dependent on the level of inductance at the loop, and the presence of a vehicle 111 changes the level of inductance which produces a change in the frequency.

The pulse comparator 112 is coupled to the oscillator, and receives the analog voltage level generated by the oscillator and converts the voltage level into a digital pulse train. The output frequency of the pulse comparator is the same as the input frequency from the loop oscillator.

A processor 114, such as a microcontroller, is coupled to receive as input the pulse train from the pulse comparator. The processor measures the frequency of the pulse train generated by the pulse comparator and thereby establishes a non-feedback control loop. The frequency of the input pulse train is measured by counting a specified number of pulses. The specified number of pulses may be determined by a device sensitivity setting that is a configurable input value. A reference time period is established by determining the time required to count the specified number of pulses at initialization of the control loop. Once the reference time period is established, the processor calculates respective durations of successive active time periods. The duration of each active time period is the time taken to count the specified number of pulses. A change in frequency, such as caused by a vehicle on the loop, changes the time required to count the specified number of pulses.

Figure 4:
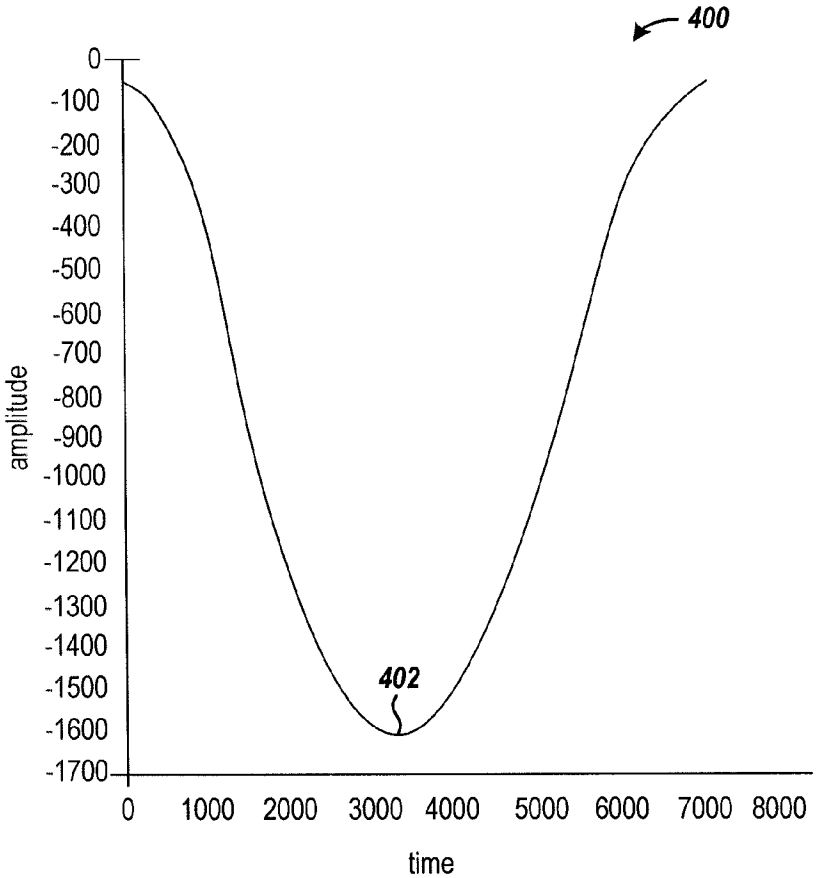
FIG. 4 is a graph of an example waveform generated by a car passing by a single inductive loop.

A waveform graph may be constructed from the durations of the active time periods relative to the reference time period, and current relative times at the end of each active period. The y-coordinate of a point of the waveform graph is calculated as the difference between the reference time period and an active time period, and the current relative time at the end of the active time period is the x-coordinate. FIG. 4 shows an example waveform graph. When the waveform y-coordinate values are less than a threshold, which may be based on a configurable sensitivity setting, the points may be stored to represent an individual vehicle. The stored points may be referred to as a vehicle waveform or a signal waveform. These stored points can then be used to run the classification algorithm described below. When the calculated y-coordinate value is greater than the threshold, the value may be discarded, indicating that no vehicle is present.

The processor 114 is coupled to the memory arrangement 116. The memory arrangement 116 is configured with model waveforms 118 and may include multiple levels of cache memory and a main memory. The memory arrangement may also be configured with program code that is executable by the processor for performing the processes and algorithms described herein. The processor compares the vehicle waveform to the stored model waveforms 118 to determine the type of the passing vehicle. Based on a length value associated with the type of the passing vehicle and the duration of the vehicle waveform, the processor calculates the speed of the vehicle.

Input/output and communication circuitry 120 is coupled to the processor. The I/O and communication circuitry may provide interfaces for wireless and/or wired communication of generated data, for example. The I/O and communication circuitry may further provide an interface for retentive storage of generated data, such as in a non-volatile memory (not shown). The processor 114, having determined the type of vehicle and the vehicle's speed, may output data indicating the type and speed. The processor may also, or alternatively, store in the memory 116 or in non-volatile memory, information associated with each vehicle detected, such as the type and speed.

Though only one inductive loop of one traffic lane is illustrated, it will be appreciated that the detector may be expanded to classify vehicles traveling in multiple traffic lanes. For example, the detector 110 may be configured with multiple oscillators that are connected to respective inductive loops in different traffic lanes. The detector may be further configured with multiple pulse comparators that are connected to the multiple oscillators, respectively. The pulse comparators may be coupled to the processor to provide respective pulse trains as described above. The processor processes each pulse train as described above and classifies vehicles in each of the traffic lanes as described below.

In an example implementation, the model waveforms may be different for different inductive loops. For example, the memory 116 in the detector 110 may be configured with model waveforms 118 that are tailored for the inductive loop 102. There may be multiple sets of model waveforms, with each set suitable for a particular inductive loop or type of inductive loop, and the processor may be instructed to select and use one of the sets of model waveforms for matching with the signal waveform according to the particular inductive loop.

Figure 2:
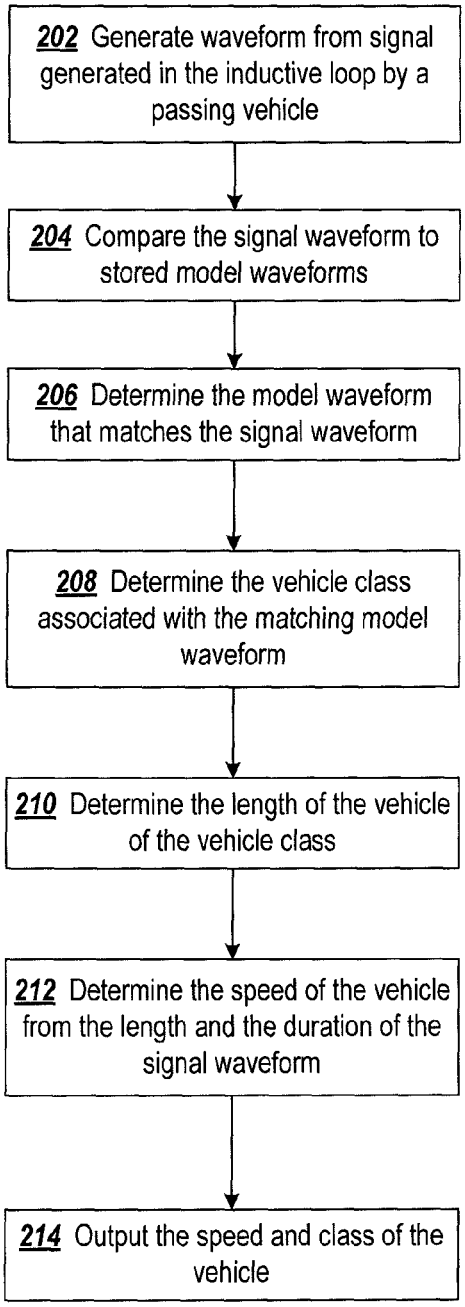
FIG. 2 is a flowchart of a process for classifying vehicles using a single inductive loop.

FIG. 2 is a flowchart of a process for classifying vehicles using a single inductive loop. At block 202, a signal waveform is generated from a signal generated in a single inductive loop by a passing vehicle. The generated signal waveform may be represented as a time-ordered set of sampled data values, which can be processed by a programmed microprocessor.

At block 204, the signal waveform is compared to the waveforms in a set of model waveforms. The model waveforms may be configured in a memory prior to operating the system to collect vehicle data. The model waveforms are representative of vehicles in a class, and each may be a set of time-ordered sample values. Alternatively, each model waveform may be represented by a value that indicates the number of negative peaks in a waveform(s) generated by one or more representative vehicles of the class. Negative peaks may alternatively be referred to as valleys. Each model waveform may be generated from a single representative vehicle or may be a composite of several representative vehicles. As will be explained further below, in some implementations respective limit masks may represent some model waveforms.

The model waveform that matches the signal waveform is determined at block 206. A match may be determined using alternative approaches. In one approach, which is shown in FIGS. 3-7 and described in more detail below, the matching proceeds in two phases. In the first phase, the signal waveform is matched against model waveforms of master classes. Each master class has an associated model waveform, and at least some of the master classes have respective subclasses. The respective subclasses of each master class also have associated model waveforms, which in an example implementation are limit masks. Each master class generally categorizes a range of vehicle lengths. For example, a first master class may encompass passenger cars, pickup trucks, and vans; a second master class may encompass vehicles with trailers, and box trucks; a third master class may encompass box trucks, buses and other vehicles with more than 2 axles; and a fourth master class may encompass tractor-trailers.

In another approach, the signal waveform is matched against model waveforms for different vehicles without the use of master classes and subclasses. A match may be determined as the model waveform having sample values that most closely match the signal waveform.

At block 208, the vehicle class associated with the matching model waveform is determined, and at block 210, the length of the vehicle of the vehicle class is determined. In an example implementation, data that indicate vehicle classes and lengths may be stored in a memory in association with the model waveforms. Thus, once the matching model waveform is determined, the associated data indicating the vehicle class and length may be read from the memory.

The speed of the vehicle is calculated at block 212. The length of the vehicle and the duration of the signal waveform may be used in the calculation. A field length of the loop 102 is stored in memory. The length associated with the vehicle class and model waveform can be used to calculate the speed with the following equation:

$$\text{Speed} = \frac{\text{Vehicle Length} + \text{Field Length}}{\text{Duration of Waveform}} * \text{Conversion Factor}$$

The conversion factor translates the length units and waveform duration units into units suitable for conveying speed information about the vehicle.

At block 214, data indicating the vehicle class and speed are output to a data collection application, for example. Alternatively, the output of the data may entail storing the data in a local memory arrangement.

Figure 3:
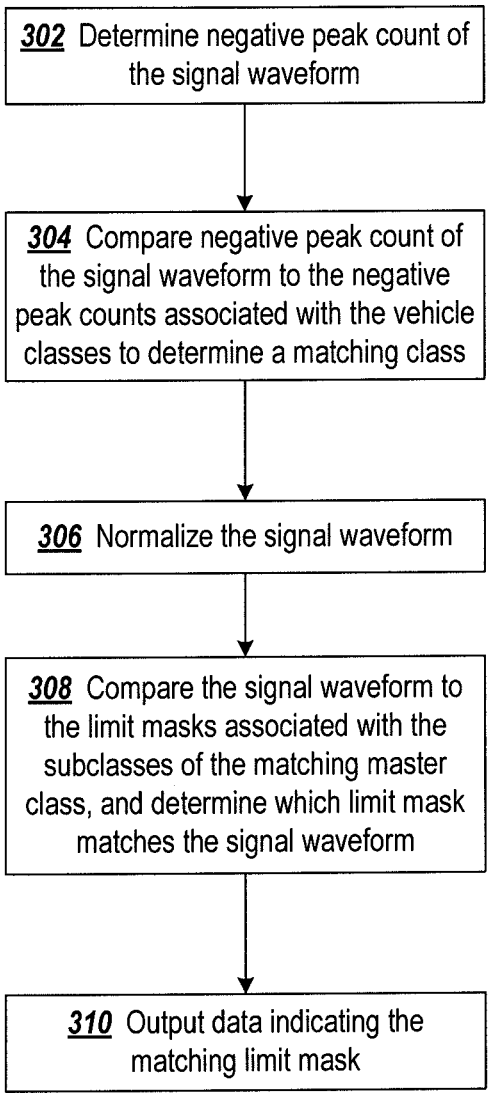
FIG. 3 is a flowchart of a process for determining which model waveform of a set of different model waveforms for different vehicles matches a signal waveform generated by a vehicle.

FIG. 3 is a flowchart of a process for determining which model waveform of a set of different model waveforms for different vehicles matches a signal waveform generated by a vehicle. The process of FIG. 3 includes two general phases. In the first phase, the process determines which model waveform of a master class matches the signal waveform. In the second phase, the process determines which model waveform of a subclass of the matching master class matches the signal waveform.

The first phase examines the negative peak count of the signal waveform versus the negative peak counts of the model waveforms of the master classes. At block 302, the negative peak count of the signal waveform is determined. In an example implementation, a peak detection algorithm as implemented in generally available software executing on a processor may be used to determine the number of negative peaks. A configuration parameter may be input to the peak detection algorithm in order to match the sensitivity of the algorithm to the sensitivity of the circuitry that produced the signal waveform from the inductive loop.

Figure 5:
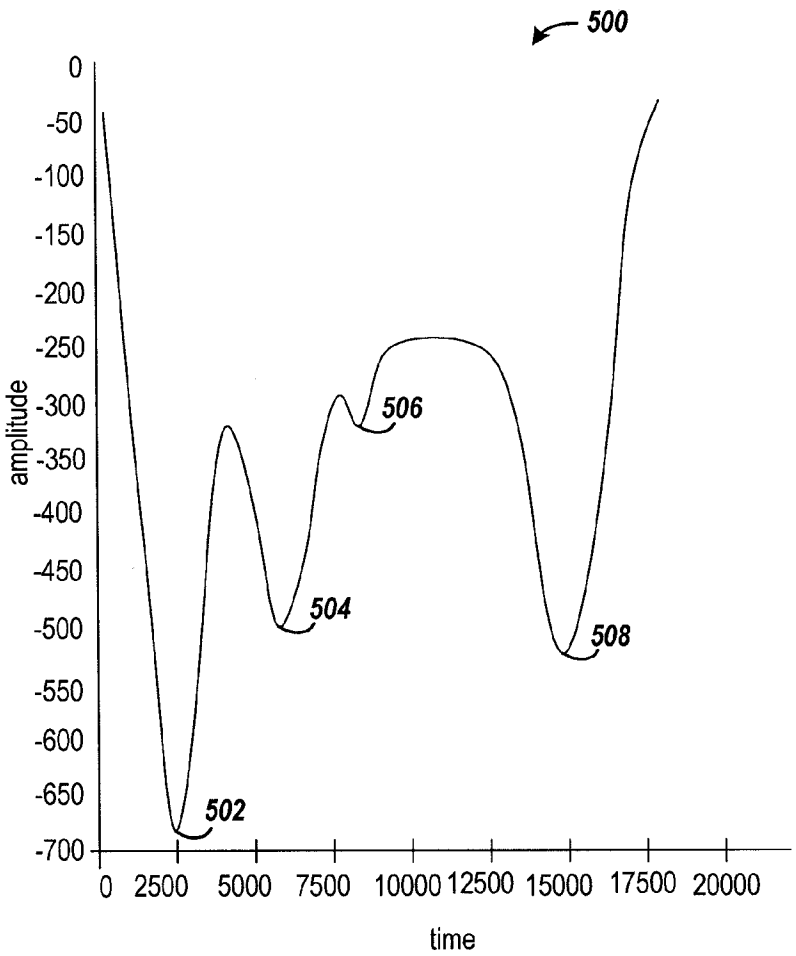
FIG. 5 is a graph of an example waveform generated by a tractor trailer passing by a single inductive loop.

Examples of negative peaks in waveforms for an automobile and for a tractor-trailer are shown in FIGS. 4 and 5, respectively. The waveform 400 in FIG. 4 has one negative peak at the point on the curve indicated by reference numeral 402. The waveform 500 of FIG. 5 has four negative peaks at points 502, 504, 506, and 508.

Returning now to FIG. 3, at block 304, the negative peak count of the signal waveform is compared to the negative peak count of the model waveform of the master class. Since the matching of the signal waveform to a master class involves comparing negative peak counts, the model waveform of a master class need not be stored as a set of time-ordered sample values. Rather, the model waveform of each master class may be indicated by the number of negative peaks. The master class having a number of negative peaks equal to the number of negative peaks in the signal waveform is determined to be the matching master class.

Once the signal waveform has been matched to a model waveform of a master class, the second phase proceeds to match the signal waveform to a subclass model waveform of the matching master class. The subclass model waveforms of the master classes are established prior to operating the system to classify vehicles. Note that all subclasses of vehicles within a class have model waveforms that have the same number of valleys.

Prior to activating the system to classify vehicles, the subclass model waveforms are configured in the system either by the end user, such as a traffic engineer, or by the maker of the system. For each subclass, the signal waveform generated by a representative vehicle of the subclass is captured. Alternatively, the signal waveforms generated by multiple representative vehicles of the subclass may be captured and combined into a single waveform. The resulting waveform may be interpolated in order to increase the resolution to a desired sample size. It has been determined that a sample size of approximately 1000 points provides sufficient resolution to determine the subclass of the vehicle. The interpolation factor to accommodate this sample size may be calculated based on the loop sensitivity (each sensitivity level produces a fixed sample rate) that has been set in the device. After interpolating, a limit mask may be generated. The limit mask has positive and negative limits for each sample of the representative waveform. For example, for each sample value of the interpolated waveform, a positive limit value is equal to the sample value increased by a selected amount, and a negative limit value is equal to the sample value decreased by a selected amount. The positive and negative offsets of the limit mask are dependent on the number of subclass master waveforms being used to classify the vehicle. The offset amounts are greater in the positive and negative limits if there are fewer classes to accommodate the possible vehicle waveforms to be classified. If there is a greater number of subclasses within the master waveforms, the offset amounts are lesser for the positive and negative limits in order to more particularly classify passing vehicles. Prior to activating the system to classify vehicles, the subclass model waveform limit masks are configured in the system either by the end user, such as a traffic engineer, or by the maker of the system. Thus, the waveforms of the limit mask conform to the interpolated waveform.

Figure 6:
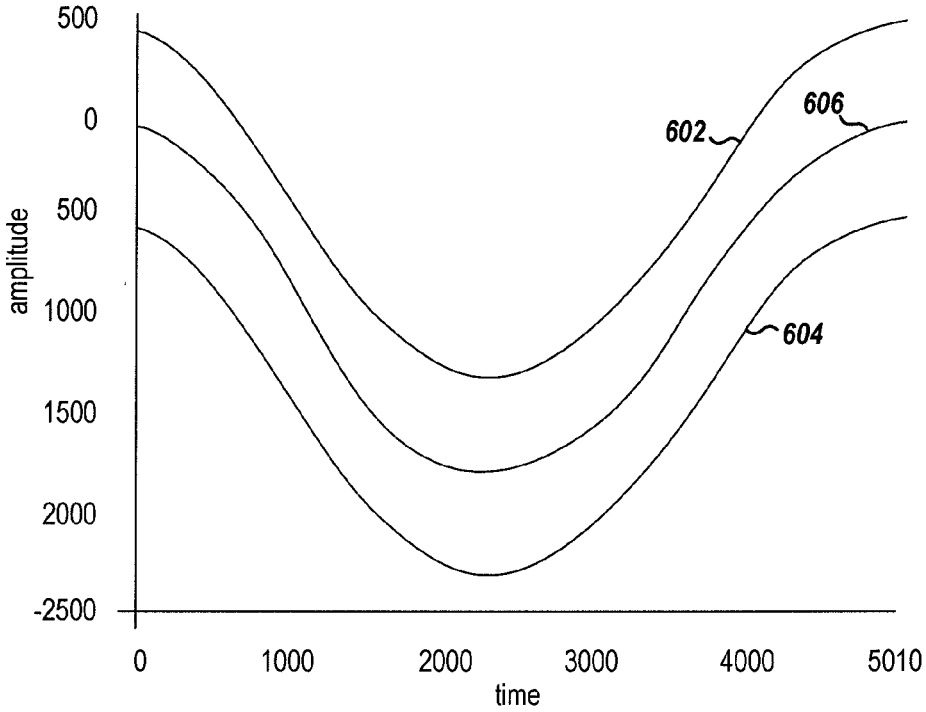
FIG. 6 is a graph of a limit mask for a car and the signal waveform generated by a car overlaid on the limit mask.

FIG. 6 shows a limit mask for an automobile. The positive limits are shown by waveform 602, and the negative limits are shown by waveform 604. Returning now to FIG. 3, at block 306, the signal waveform is normalized to match the subclass model waveforms of the matching master class. The signal waveform is interpolated to match the sample size of the subclass model waveforms, and the time between samples in the signal waveform is changed to equal the time between samples in the subclass model waveforms.

At block 308, the normalized signal waveform is compared to the limit masks of the subclasses of the matching master class to determine which limit mask matches the signal waveform. The signal waveform matches a limit mask if all points of the signal waveform fall between the positive and negative limits of the limit mask. FIG. 6 shows an example in which the signal waveform 606, as generated by a vehicle passing an inductive loop, matches the limit mask having positive limits of waveform 602 and negative limits of waveform 604. All samples of the signal waveform 606 are between the positive limits of waveform 602 and negative limits of waveform 604. If the signal waveform matches more than one of the limit masks, the positive and negative offsets of those matching waveforms are reduced, making the limit mask narrower and closer to the actual signal. The normalized signal may then be compared to each matching limit mask again. This process may be repeated until the normalized waveform only matches a single subclass limit mask.

Figure 7:
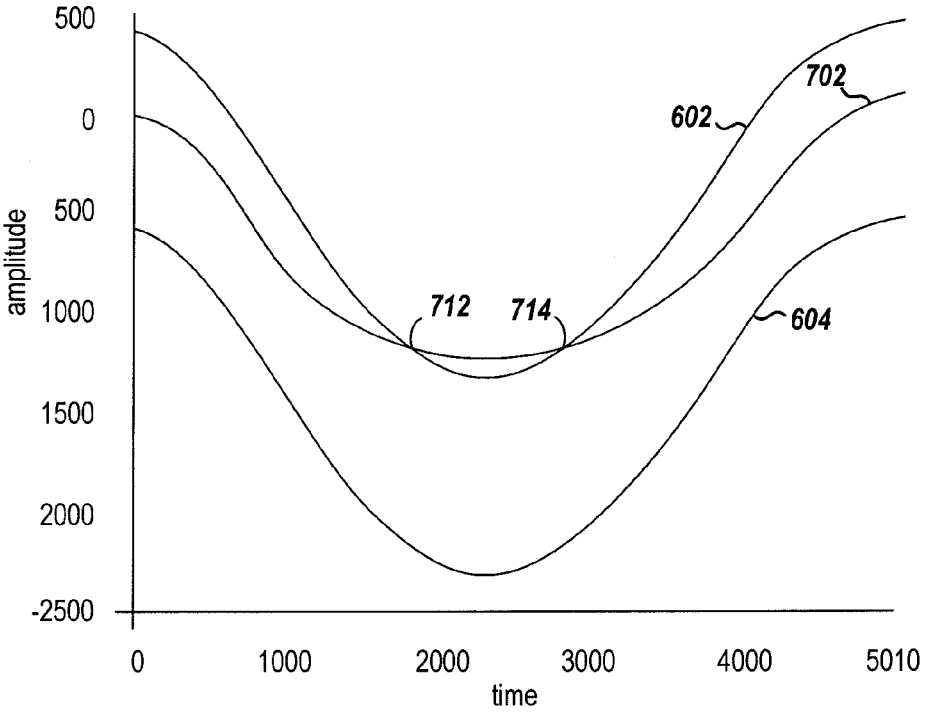
FIG. 7 is a graph in which the signal waveform generated by a car does not completely fall within the limit mask.

In some instances, the signal waveform may not match any of the limit masks of the subclasses of the matching master class. FIG. 7 shows the limit mask for an automobile and a signal waveform 702. The signal waveform 702 does not match the limit mask because not all the samples are between the positive limits 602 and negative limits 604. Between points 712 and 714, samples of the signal waveform are greater than the corresponding samples of the positive limits 602. The samples outside the limit mask may be referred to as failure points. In one implementation, if the signal waveform does not perfectly match any of the limit masks of the subclasses of the matching master class, the limit mask for which the signal waveform has the fewest number of failure points may be selected as the matching limit mask.

At block 310, the process outputs data indicating the matching limit mask, and data associated with the matching limit mask may then be used to determine the length of the vehicle as shown in block 208 in FIG. 2 and described above.

Though aspects and features may in some cases be described in individual figures, it will be appreciated that features from one figure can be combined with features of another figure even though the combination is not explicitly shown or explicitly described as a combination.

The present invention is thought to be applicable to a variety of systems for classifying vehicles. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method of vehicle classification, comprising:

generating a signal waveform from a signal in a single inductive loop generated by a passing vehicle;

comparing the signal waveform to a first plurality of model waveforms, wherein each model waveform is associated with a respective class of vehicle;

determining a first model waveform of the first plurality of model waveforms that matches the signal waveform; and outputting data indicating the respective class of vehicle associated with the first model waveform.

2. The method of claim 1, wherein each respective class of vehicle has an associated vehicle length value and the method further comprising outputting the vehicle length value associated with the first model waveform.

3. The method of claim 2, further comprising:

determining a duration of the signal waveform;

determining a speed of the vehicle as a function of the duration and the vehicle length value associated with the first model waveform; and outputting data indicative of the speed of the vehicle.

4. The method of claim 1, wherein the determining the first model waveform of the first plurality of model waveforms that matches the signal waveform includes:

comparing a number of negative peaks in the signal waveform to respective numbers of negative peaks in model waveforms of the first plurality of model waveforms; and determining the first model waveform to be a model waveform of the first plurality of model waveforms having a respective number of negative peaks closest to the number of negative peaks in the signal waveform.

5. The method of claim 1, further comprising:

comparing the signal waveform to a second plurality of model waveforms, wherein one or more of the classes has two or more subclasses of vehicles, and each of the subclasses has an associated model waveform of the second plurality of model waveforms;

determining a second model waveform of the second plurality of model waveforms that matches the signal waveform; and outputting data indicating the respective subclass of vehicle associated with the second model waveform.

6. The method of claim 5, wherein each respective subclass of vehicle has an associated vehicle length value and the method further comprising outputting the vehicle length value associated with the subclass of vehicle that is associated with the second model waveform.

7. The method of claim 6, further comprising:

determining a duration of the signal waveform;

determining a speed of the vehicle as a function of the duration and the vehicle length value associated with the subclass of vehicle that is associated with the second model waveform; and outputting data indicative of the speed of the vehicle.

8. The method of claim 5, wherein the determining the first model waveform of the first plurality of model waveforms that matches the signal waveform includes:

comparing a number of negative peaks in the signal waveform to respective numbers of negative peaks in model waveforms of the first plurality of model waveforms; and determining the first model waveform to be a model waveform of the first plurality of model waveforms having a respective number of negative peaks closest to the number of negative peaks in the signal waveform.

9. The method of claim 8, wherein the determining the second model waveform of the second plurality of model waveforms that matches the signal waveform includes:

comparing the signal waveform to respective limit masks corresponding to the model waveforms of the second plurality of model waveforms;

determining whether or not any of the limit masks cover all points of the signal waveform; and determining the second model waveform to be a model waveform of the second plurality of model waveforms having a corresponding limit mask that covers all points of the signal waveform.

10. The method of claim 9, further comprising:

in response to determining that none of the limit masks cover all points of the signal waveform, determining the second model waveform to be a model waveform of the second plurality of model waveforms having a corresponding limit mask for which a least number of points of the signal waveform fall outside the limit mask.

11. A system for classifying a vehicle passing a single inductive loop, comprising:

an oscillator coupled to the single inductive loop;

a pulse comparator coupled to the oscillator, the pulse comparator configured to generate a pulse train in response to an output signal from the oscillator;

a processor coupled to the pulse comparator; and a memory coupled to the processor, wherein the memory is configured with a plurality of model wave forms and with instructions that when executed by the processor cause the processor to:

generate a signal waveform from a signal in the single inductive loop generated by a passing vehicle;

compare the signal waveform to a first plurality of model waveforms, wherein each model waveform is associated with a respective class of vehicle;

determine a first model waveform of the first plurality of model waveforms that matches the signal waveform; and output data indicating the respective class of vehicle associated with the first model waveform.

12. The system of claim 11, wherein each respective class of vehicle has an associated vehicle length value, and the memory is further configured with instructions that when executed by the processor cause the processor to output the vehicle length value associated with the first model waveform.

13. The system of claim 12, wherein the memory is further configured with instructions that when executed by the processor cause the processor to:

determine a duration of the signal waveform;

determine a speed of the vehicle as a function of the duration and the vehicle length value associated with the first model waveform; and output data indicative of the speed of the vehicle.

14. The system of claim 11, wherein the instructions that cause the processor to determine the first model waveform of the first plurality of model waveforms that matches the signal waveform include instructions that cause the processor to:

compare a number of negative peaks in the signal waveform to respective numbers of negative peaks in model waveforms of the first plurality of model waveforms; and determine the first model waveform to be a model waveform of the first plurality of model waveforms having a respective number of negative peaks closest to the number of negative peaks in the signal waveform.

15. The system of claim 11, wherein the memory is further configured with instructions that when executed by the processor cause the processor to:

compare the signal waveform to a second plurality of model waveforms, wherein one or more of the classes has two or more subclasses of vehicles, and each of the subclasses has an associated model waveform of the second plurality of model waveforms;

determine a second model waveform of the second plurality of model waveforms that matches the signal waveform; and output data indicating the respective subclass of vehicle associated with the second model waveform.

16. The system of claim 15, wherein each respective subclass of vehicle has an associated vehicle length value, and the memory is further configured with instructions that when executed by the processor cause the processor to output the vehicle length value associated with the subclass of vehicle that is associated with the second model waveform.

17. The system of claim 16, wherein the memory is further configured with instructions that when executed by the processor cause the processor to:

determine a duration of the signal waveform;

determine a speed of the vehicle as a function of the duration and the vehicle length value associated with the subclass of vehicle that is associated with the second model waveform; and output data indicative of the speed of the vehicle.

18. The system of claim 15, wherein the instructions that cause the processor to determine the first model waveform of the first plurality of model waveforms that matches the signal waveform include instructions that cause the processor to:

compare a number of negative peaks in the signal waveform to respective numbers of negative peaks in model waveforms of the first plurality of model waveforms; and determine the first model waveform to be a model waveform of the first plurality of model waveforms having a respective number of negative peaks closest to the number of negative peaks in the signal waveform.

19. The system of claim 18, wherein the instructions that cause the processor to determine the second model waveform of the second plurality of model waveforms that matches the signal waveform include instructions that cause the processor to:

compare the signal waveform to respective limit masks corresponding to the model waveforms of the second plurality of model waveforms;

determine whether or not any of the limit masks cover all points of the signal waveform; and determine the second model waveform to be a model waveform of the second plurality of model waveforms having a corresponding limit mask that covers all points of the signal waveform.

20. The system of claim 19, wherein the memory is further configured with instructions that when executed by the processor cause the processor to:

determine, in response to determining that none of the limit masks cover all points of the signal waveform, the second model waveform to be a model waveform of the second plurality of model waveforms having a corresponding limit mask for which a least number of points of the signal waveform fall outside the limit mask.

* * * * *